US009702356B2

(12) United States Patent
Brück et al.

(10) Patent No.: US 9,702,356 B2
(45) Date of Patent: Jul. 11, 2017

(54) DEVICE FOR PROVIDING A LIQUID ADDITIVE

(71) Applicant: CONTINENTAL AUTOMOTIVE GMBH, Hanover (DE)

(72) Inventors: Rolf Brück, Bergisch Gladbach (DE); Jan Hodgson, Troisdorf (DE)

(73) Assignee: Continental Automotive GmbH, Hannover (DE)

( * ) Notice: Subject to any disclaimer, the term of this patent is extended or adjusted under 35 U.S.C. 154(b) by 0 days.

(21) Appl. No.: 14/765,273

(22) PCT Filed: Jan. 9, 2014

(86) PCT No.: PCT/EP2014/050254
§ 371 (c)(1),
(2) Date: Jul. 31, 2015

(87) PCT Pub. No.: WO2014/117971
PCT Pub. Date: Aug. 7, 2014

(65) Prior Publication Data

US 2016/0003231 A1 Jan. 7, 2016

(30) Foreign Application Priority Data

Feb. 1, 2013 (DE) ..... 10 2013 101 029

(51) Int. Cl.
*F04B 43/12* (2006.01)
*F01N 3/20* (2006.01)

(52) U.S. Cl.
CPC ..... *F04B 43/1238* (2013.01); *F01N 3/208* (2013.01); *F04B 43/12* (2013.01); *F04B 43/123* (2013.01)

(58) Field of Classification Search
CPC .... F04B 1/063; F04B 27/0673; F04B 43/086; F04B 43/088; F04B 43/123; F04B 43/1253; F04B 43/1292; F04B 49/007
See application file for complete search history.

(56) References Cited

U.S. PATENT DOCUMENTS 3,433,170 A * 3/1969 Malbec ..... F04B 43/0072 417/412
4,997,347 A 3/1991 Roos
(Continued)

FOREIGN PATENT DOCUMENTS

CN 200946560 9/2007
CN 101078398 11/2007
(Continued)

OTHER PUBLICATIONS

Machine translation of DE 3511572 A1, accessed on Sep. 1, 2016.*
Office Action dated Sep. 5, 2016 which issued in the corresponding Japanese Patent Application No. 2015-555625.

*Primary Examiner* — Jonathan Matthias
(74) *Attorney, Agent, or Firm* — Cozen O'Connor

(57) ABSTRACT

A device for providing a liquid additive includes at least one first pump chamber (3) for conveying the liquid additive, and a rotary drive. The first pump chamber is arranged around a drive axis of the rotary drive. Inside the first pump chamber, at least one seal is formed, which can be displaced from the rotary drive around the drive axis. The device has at least one second pump chamber, which is arranged along the drive axis adjacent to the first pump chamber.

8 Claims, 4 Drawing Sheets

(56) References Cited

U.S. PATENT DOCUMENTS

| | | | | |
|---|---|---|---|---|
| 5,006,049 | A | 4/1991 | von der Heyde et al. | |
| 5,032,065 | A * | 7/1991 | Yamamuro | F04B 1/063 417/428 |
| 5,033,943 | A | 7/1991 | Durrum et al. | |
| 5,286,176 | A * | 2/1994 | Bonin | F04B 43/123 417/322 |
| 5,988,998 | A | 11/1999 | Glover | |
| 6,024,545 | A | 2/2000 | Morioka | |
| 2005/0271525 | A1 | 12/2005 | Muramatsu et al. | |
| 2009/0301064 | A1 * | 12/2009 | Maier | F01N 3/2066 60/286 |
| 2011/0158822 | A1 | 6/2011 | Bartels | |
| 2014/0065022 | A1 | 3/2014 | Overhoff et al. | |
| 2014/0112806 | A1 | 4/2014 | Wright | |

FOREIGN PATENT DOCUMENTS

| | | |
|---|---|---|
| CN | 201074582 | 6/2008 |
| CN | 102878064 | 1/2013 |
| DE | 15 28 964 | 6/1969 |
| DE | 69 30 688 | 10/1970 |
| DE | 35 11 572 | 10/1986 |
| DE | 10 2006 016571 A1 | 10/2007 |
| DE | 10 2008 042235 B3 | 3/2010 |
| DE | 10 2011 014634 A1 | 9/2012 |
| EP | 2 541 010 A1 | 1/2013 |
| JP | 01-315687 | 12/1989 |
| JP | 10-18973 | 1/1998 |
| JP | 10-77969 | 3/1998 |
| JP | 10-238479 | 9/1998 |
| JP | 2000-320472 | 11/2000 |
| JP | 2010-007617 | 1/2010 |

* cited by examiner

DEVICE FOR PROVIDING A LIQUID ADDITIVE

CROSS-REFERENCE TO RELATED APPLICATIONS

This is a U.S. national stage of application No. PCT/EP2014/050254, filed on 9 Jan. 2014, which claims priority to the German Application No. DE 10 2013 101 029.6 filed 1 Feb. 2013, the content of both incorporated herein by reference.

BACKGROUND OF THE INVENTION

1. Field of the Invention

The invention relates to a device for supplying a liquid additive. Devices of this type are used, for example, in the automotive sector to feed a liquid additive to the exhaust-gas treatment device of an internal combustion engine.

2. Related Art

For example, widespread use is made of exhaust-gas treatment devices in which nitrogen oxide compounds in the exhaust gas of an internal combustion engine are reduced with the aid of a reducing agent. The corresponding exhaust-gas purification method is referred to as the SCR (Selective Catalytic Reduction) method. Ammonia is typically used as reduing agent. The ammonia reacts with the nitrogen oxide compounds on an SCR catalytic converter in the exhaust-gas treatment device.

Ammonia is normally fed to the exhaust-gas treatment device not directly but rather in the form of a precursor solution that can be stored and supplied as liquid additive. The precursor solution is converted, in the exhaust gas, into ammonia. A particularly widely used precursor solution is urea-water solution, which is available for example under the trade name AdBlue® with a urea content of 32.5%.

For the delivery of liquid additive, a device for supplying liquid additive typically has a pump. A pump of this type should, on the one hand, be as inexpensive as possible and, on the other hand, permit highly reliable operation of the device. The operation of the device gives rise to various demands on the pump. Firstly, it should be possible for the delivery rate of the pump to be adapted during operation to different operating conditions of the exhaust-gas treatment device.

Furthermore, it may be necessary for the delivery pressure generated by the pump to correspond as precisely as possible to a predefined pressure range.

At the same time, a device for supplying liquid additive must, even in the presence of frozen additive, be ready for use again quickly. A urea-water solution freezes, for example, at temperatures below −11° C. When this happens, a volume expansion occurs, which can damage the lines in a device for supplying liquid additive. In motor vehicles, such low temperatures arise in particular during long standstill phases. A device for supplying liquid additive should thus be designed and/or set up such that it is not damaged by the volume expansion of the liquid additive during the freezing process. This may be realized, for example, by virtue of the device being evacuated upon a stoppage of operation. It is also possible for the device to be designed so as to compensate the volume expansion.

SUMMARY OF THE INVENTION

Taking these various requirements as a starting point, it is therefore an object of the present invention to solve or at least alleviate the technical problems highlighted in connection with the prior art. It is sought in particular to propose a particularly advantageous device for supplying liquid additive.

The objects are achieved, according to an aspect of the invention by a device for supplying liquid additive, having at least one first pump chamber for the delivery of the liquid additive and having a rotary drive, wherein the first pump chamber is arranged around a drive shaft of the rotary drive and, within the first pump chamber, there is formed at least one seal which can be displaced around the drive shaft by the rotary drive, wherein the device has at least one second pump chamber which is arranged adjacent to the first pump chamber along the drive shaft.

The device for supplying liquid additive is preferably inserted into a tank base of a tank for the liquid additive. The device preferably has a housing which, in the installed state in the tank, forms a section of the tank base of the tank. On the housing of the device there is preferably provided an intake point at which liquid additive can be extracted from the tank. Furthermore, the device preferably has a discharge point at which the device supplies the liquid additive and to which an (external) line for the liquid additive can be connected.

The device is preferably configured to supply a respectively required delivery rate of liquid additive. A required delivery rate is determined, for example, from a corresponding demand from a control unit of a motor vehicle. The required delivery rate is, for example, the flow rate of liquid additive required for the effective purification of the exhaust gases in an exhaust-gas treatment device of the motor vehicle (at the present time and/or under the present load). The device can vary the delivery rate of the liquid additive, for example, through adaptation of the power of the rotary drive, such that the flow rate of liquid additive delivered by the device corresponds to the required delivery rate. The device may also have additional components that permit or improve the adaptation of the delivery rate. For example, the device may have a dedicated control unit that converts an external demand from a control unit of the motor vehicle with regard to a required delivery rate into electrical signals for suitable activation of the rotary drive of the device.

The liquid additive is preferably the above-described urea-water solution. A delivery duct (or at least one delivery duct) extends through the device from the intake point to the discharge point, through which delivery duct the liquid additive is delivered. A pump chamber forms a section of the delivery duct. The delivery of the liquid additive takes place in the pump chamber. This means in particular that the mechanical energy required for the delivery action is imparted to the liquid additive in the pump chamber. The rotary drive of the device is preferably in the form of an electric motor that can generate a rotational movement. The rotary drive together with the pump chamber may be referred to as pump of the device.

The drive shaft of the rotary drive is along an (imaginary) axis, which extends along the axis of rotation of the rotary drive. The first pump chamber is preferably arranged not directly around the rotary drive but around the drive shaft in an elongation of the drive shaft proceeding from the rotary drive.

At least one seal is formed in the pump chamber. At least one closed-off delivery volume is formed within the pump chamber by the seal. As a result of the displacement of the seal within the pump chamber, the closed-off delivery volume is (spatially) displaced. This leads to a delivery of the liquid additive. On the drive shaft of the pump there is preferably formed a transmission that transmits a movement at the drive shaft to the seal. The transmission may be, for example, a profiled disk and/or a cam disk.

The second pump chamber is preferably arranged adjacent to the first pump chamber with a spacing along the drive shaft. The spacing may, for example, amount to between 1 cm [centimeter] and 10 cm.

This configuration of the device has the effect in particular that multiple pump chambers (which are in parallel and/or impinged on by flow separately) can be operated (temporally) conjointly by way of a (single) rotary drive. Thus, a technically simple and compact construction of the device is specified. Furthermore, it is the case in particular for so-called dosing pumps (delivery of constant delivery volumes) that a significant increase in the delivery rate is made possible, as will be discussed in more detail below.

It is particularly advantageous if the second pump chamber is constructed in the manner of the first pump chamber.

The second pump chamber thus preferably also has at least one seal that forms at least one closed delivery volume within the second pump chamber. Furthermore, it is preferably also the case that all other features, and in particular the features stated here, of the first pump chamber and of the second pump chamber correspond.

It is furthermore advantageous if the second pump chamber can be connected in parallel with the first pump chamber, in order to increase the delivery rate of the device.

In the case of the second pump chamber being connected in parallel with the first pump chamber, it is thus possible for a first proportion of the liquid additive to flow through the first pump chamber and for a second proportion of the liquid additive to flow through the second pump chamber. The first pump chamber and the second pump chamber form two branches, which run in parallel, of the delivery duct from the intake point to the discharge point. If the preferred design variant of the device is realized with a first pump chamber and second pump chamber of identical construction, the connection of the first pump chamber and of the second pump chamber in parallel has the effect of approximately doubling the delivery rate of the device.

It is preferably provided that the parallel connection is of permanent form or can be (temporarily) eliminated merely by the additional operation of a positioning structure. If only the first pump chamber is utilized for the delivery action, the energy required for the delivery action is reduced, because the second pump chamber does not need to be operated. This permits particularly energy-efficient operation of the device when the required delivery rate is low.

Furthermore, the device is advantageous if, between the first pump chamber and the second pump chamber, there is provided a separable coupling by which the second pump chamber can be decoupled from the drive shaft.

A separable coupling of this type may, for example, be in the form of a claw-type coupling, in the form of a frictionally engaging coupling and/or in the form of an electromagnetic coupling. The coupling may, for example, be operated by way of an electromagnetic actuator. The separation of the second pump chamber, by way of a separable coupling of this type, permits a particularly effective deactivation of the drive of the second pump chamber in order to permit particularly energy-efficient operation of the device when the required delivery rate of the device is low.

In a preferred design variant of the device, the device has a dedicated control unit configured to actuate the seperable coupling in accordance with demand. If the required delivery rate is high and the control unit of the device receives a corresponding demand, the separable coupling is closed such that the first pump chamber and the second pump chamber are operated in parallel. If the required delivery rate is low and the control unit of the device receives a corresponding demand, the separable coupling is opened such that only the first pump chamber is operated and the second pump chamber is decoupled. It is preferably the case that no program code elements whatsoever relating to the separable coupling are stored in the control unit of a motor vehicle. The actuation of the separable coupling can be performed entirely by the control unit of the device.

It is furthermore advantageous if the second pump chamber can be connected in series with the first pump chamber in order to increase the delivery pressure of the device.

In the case of such a series connection, (all of) the liquid additive flows along the delivery duct through the device, firstly through the first pump chamber, and subsequently through the second pump chamber. During the operation of the device with a series connection of the first pump chamber and of the second pump chamber, the pressure of the liquid additive is initially increased in the first pump chamber, before subsequently being further increased in the second pump chamber. A particularly greatly increased delivery pressure of the device is required, for example, in order to realize a particular spray pattern at a feed device for feeding the liquid additive to an exhaust-gas treatment device. A feed device of such type has, for example, a nozzle. The higher the pressure of the liquid additive is at the feed device, the finer is the spray produced at a nozzle of the feed device.

It is also possible, in the situation where the first pump chamber and the second pump chamber are connected in series, for a separable coupling to be provided, by which the second pump chamber can be decoupled from the drive shaft. The separable coupling may have all the characteristics described further above.

It is also possible for the device to be designed such that the first pump chamber and the second pump chamber can be alternatively connected in series or in parallel. In this case, it is selectively possible to realize an increase in the delivery rate (with the pump chambers being connected in parallel) or an increase in the delivery pressure (with the pump chambers being connected in series).

It is furthermore advantageous if the first pump chamber is at least partially delimited by a deformable diaphragm that forms the at least one seal, wherein, for the displacement of the seal, the diaphragm can be deformed by an eccentric drive connected to the rotary drive.

The diaphragm is preferably composed of an adequately thick elastic material that can be deformed under the action of the eccentric drive. The diaphragm is preferably between 2 mm [millimeters] and 20 mm thick. The diaphragm is preferably of tubular form and inserted in annular fashion into a housing. The diaphragm preferably has an approximately circular cross section, a length of 5 mm to 30 mm, a wall thickness of 2 mm to 20 mm, and an internal diameter of 30 mm to 200 mm. In this case, the wall thickness corresponds to the above-stated thickness of the diaphragm. The eccentric drive is connected to the rotary drive and can deform the diaphragm such that sections of the diaphragm are pushed into the circular housing in order to form the seals. The eccentric drive preferably acts on the annular or tubular diaphragm at the inner side of the diaphragm, in order to deform the latter.

During a rotational movement of the eccentric drive, the seal is displaced. This displacement of the seal causes the closed-off delivery volumes in the pump chamber(s) to be displaced. Thus, delivery of the liquid additive is realized by way of a movement of the rotary drive, or by way of a movement of the eccentric drive. The pump chamber preferably has an inlet and an outlet for the liquid additive. Between the outlet and the inlet as viewed in the direction of rotation of the rotary drive, there is preferably formed a static seal element which may be, for example, a protruding lug of the housing. This lug ensures that there is always a sealing point formed between the outlet and the inlet, such that liquid additive cannot flow from the outlet of the pump chamber directly to the inlet of the pump chamber. To form the seal, the diaphragm is deformed by the lug.

A pump chamber formed in this way is particularly reliable and is particularly energy-efficient in operation. Furthermore, multiple such pump chambers may particularly advantageously be arranged adjacent to one another along a drive shaft of the rotary drive. Therefore, this design permits the particularly advantageous configuration of a device, having multiple pump chambers, for supplying liquid additive.

It is furthermore advantageous if the first pump chamber is at least partially formed by a hose, wherein the at least one seal is formed by virtue of the hose being compressed in sections by a pinch disk connected to the rotary drive, wherein, for the displacement of the seal, the hose can be deformed by the pinch disk.

In the case of such a configuration of a pump chamber, the seals of the pump chambers are displaced by virtue of the pinched points of the hose being continuously displaced along a delivery direction from an inlet of the pump chamber to an outlet of the pump chamber. The pinched points are formed in the vicinity of the inlet of the pump chamber. The pinched points are then displaced along the pump chamber before subsequently being eliminated again at the outlet of the pump chamber. Closed delivery volumes are formed in each case between the individual pinched points or the individual seals.

Such a design of a pump chamber of a device for supplying liquid additive can be realized particularly easily and inexpensively. Furthermore, in the case of such a design of a pump chamber, it is particularly advantageously possible for multiple pump chambers to be arranged adjacent to one another along a drive shaft of a rotary drive of the device. For example, a hose may be led with multiple windings around the drive shaft of the rotary drive of the device in order to form multiple adjacent pump chambers of the device.

In any case, it is, for example, also possible for 3, 4, 5 or more parallel and/or series pump chambers to be operated by way of the common rotary drive.

The device is furthermore advantageous if the first pump chamber and the second pump chamber surround the drive shaft in the manner of a circular arc segment, in each case over at least 250° [angular degrees].

It is particularly advantageous if the circumference of the drive shaft of the rotary drive is utilized almost entirely for the pump chamber, in order to permit the best possible transmission of the drive power of the rotary drive to the pump chamber. It is generally not possible for the pump chamber to extend all the way around the drive shaft, because it is also necessary for space to be provided for the inlet and the outlet of the pump chamber. Therefore, it has been found that, in particular, circular arc segments of between 250° and 320° are advantageous for forming the first pump chamber and the second pump chamber.

The device is furthermore advantageous if it has at least one valve by which at least one connecting line between the first pump chamber and the second pump chamber can be switched.

By a valve of this type, it is possible to connect lines between the individual pump chambers for parallel connection and/or for series connection to be selectively opened up and closed off.

Here, a description shall be given of a specific valve that has three different positions and two inlet lines and two outlet lines:

- In a first position, a first inlet line is connected to a first outlet line, whereas a second inlet line and a second outlet line are in each case closed off.
- In a second position, the first inlet line is connected to the second outlet line. At the same time, the second inlet line is connected to the first outlet line.
- In a third position, both the first inlet line and the second inlet line are connected to the first outlet line. The second outlet line is simultaneously closed off.

With this specific valve, it is selectively possible to implement operation only with a first pump chamber (first position), series operation of the pump chambers (second position), or a parallel operation of the pump chambers (third position). The specific valve described may also be realized by way of a specific interconnection of multiple conventional valve types (two-way valves and/or three-way valves).

It is however also possible for a parallel connection of the first pump chamber and of the second pump chamber to be made possible without the need for any valve whatsoever in the device. This is possible in particular if the seals within the pump chambers ensure that a return flow of liquid additive through a pump chamber counter to the delivery direction from the intake point to the discharge point is prevented. For this purpose, it must however be ensured that the seals within the pump chambers are not displaced by the occurring pressure difference between the inlet and the outlet. This is normally realized by way of the internal friction of the rotary drive and the internal friction within the pump chamber.

It is also possible for yet further pump chambers to be arranged adjacent to the first pump chamber and to the second pump chamber along the drive shaft. For example, it is possible for a third pump chamber or even a third pump chamber and a fourth pump chamber to be provided.

By such configurations, it is possible for the delivery rate and/or the delivery pressure of the device to be yet further varied, such that more precise adaptation of the delivery rate to a demand for liquid additive is possible.

According to another aspect, a motor vehicle is provided having an internal combustion engine and having an exhaust-gas treatment device for the purification of the exhaust gases of the internal combustion engine, wherein a device described here is provided for feeding a liquid additive to the exhaust-gas treatment device.

In the exhaust-gas treatment device there is preferably provided an SCR catalytic converter at which nitrogen oxide compounds in the exhaust gas of the internal combustion engine can be reduced with the aid of a reducing agent. The reducing agent may be fed in the form of a liquid additive to the exhaust-gas treatment device by way of a feed device. Liquid additive is supplied from a tank to the feed device by a described device. The feed device and the described device may be controlled by a control unit of the motor vehicle. The feed device may have a nozzle for finely atomized metering of the liquid additive to the exhaust-gas treatment device, and/or an injector for controlling the dosing of the liquid additive.

BRIEF DESCRIPTION OF THE DRAWINGS

The invention and the technical field will be explained in more detail below on the basis of the figures. The figures show particularly preferred exemplary embodiments, to which the invention is however not restricted. In particular, it should be noted that the figures and in particular the illustrated proportions are merely schematic. In the figures.

DETAILED DESCRIPTION OF THE PRESENTLY PREFERRED EMBODIMENTS

Figure 1:
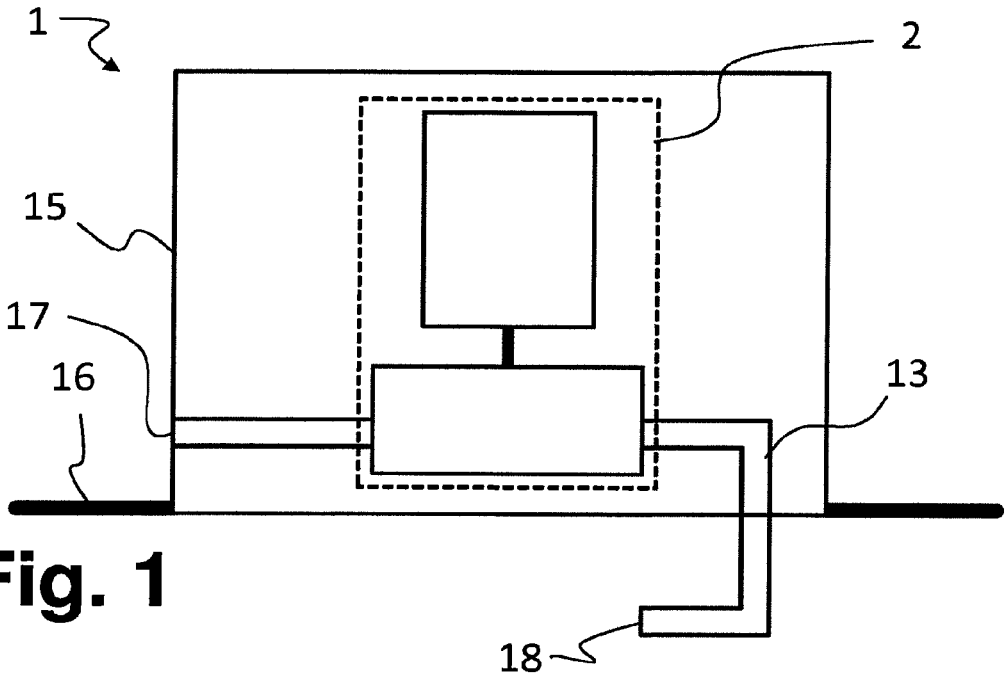
FIG. 1: shows a described device for supplying a liquid additive.

FIG. 1 shows a device 1 for supplying a liquid additive, which device is inserted into a tank base 16 (only sections of which are illustrated here) of a tank. The device 1 has a housing 15 that seals against the tank base 16. On the device 1 there is provided an intake point 17 at which the device 1 can extract liquid additive from the tank and deliver the liquid additive to a discharge point 18. For this purpose, the device 1 has a pump 2. A delivery duct 13 extends through the device 1 from the intake point 17 to the discharge point 18.

Figure 2:
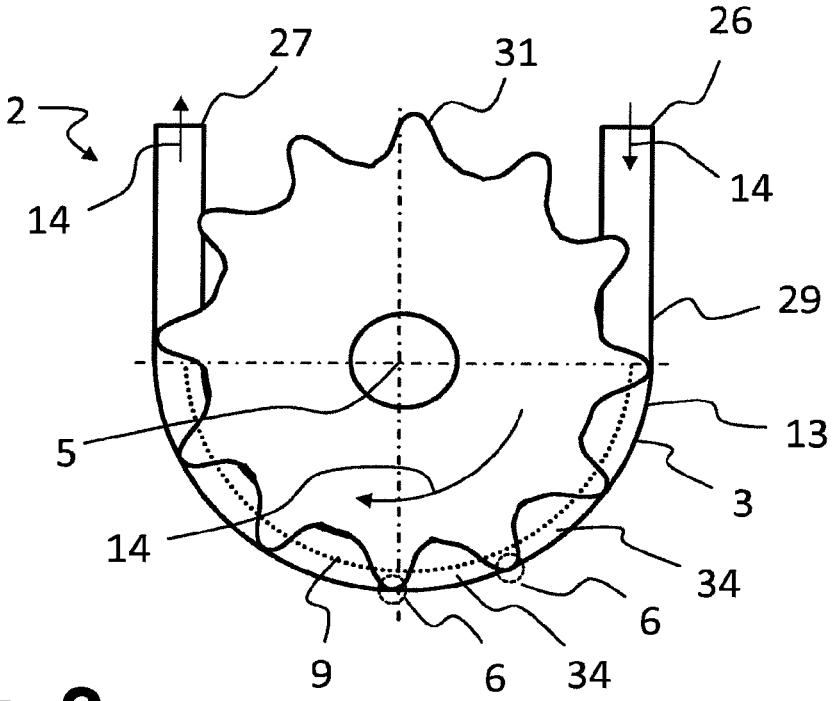
FIG. 2: is a sectional illustration, perpendicular to the drive shaft, through a first design variant of a pump for a described device.

In the sectional illustration of a first design variant of a pump 2 for a described device in FIG. 2, it is possible to see a first pump chamber 3 in the form of a hose 29. The hose 29 forms a delivery duct 13.

The hose 29 is deformed in sections by a pinch disk 31, such that seals 6 are formed within the pump chamber 3. Between the seals 6, the hose forms closed delivery volumes 34 in each case. The pinch disk 31 is aligned correspondingly with the drive shaft 5 of a rotary drive (not illustrated here) of the pump 2. Rotation of the pinch disk 31 about the drive shaft 5 causes a displacement of the (constant) delivery volume 34 and thus a delivery of the liquid additive through the first pump chamber 3 or the hose 29 in the delivery direction 14 from an inlet 26 to an outlet 27.

Figure 3:
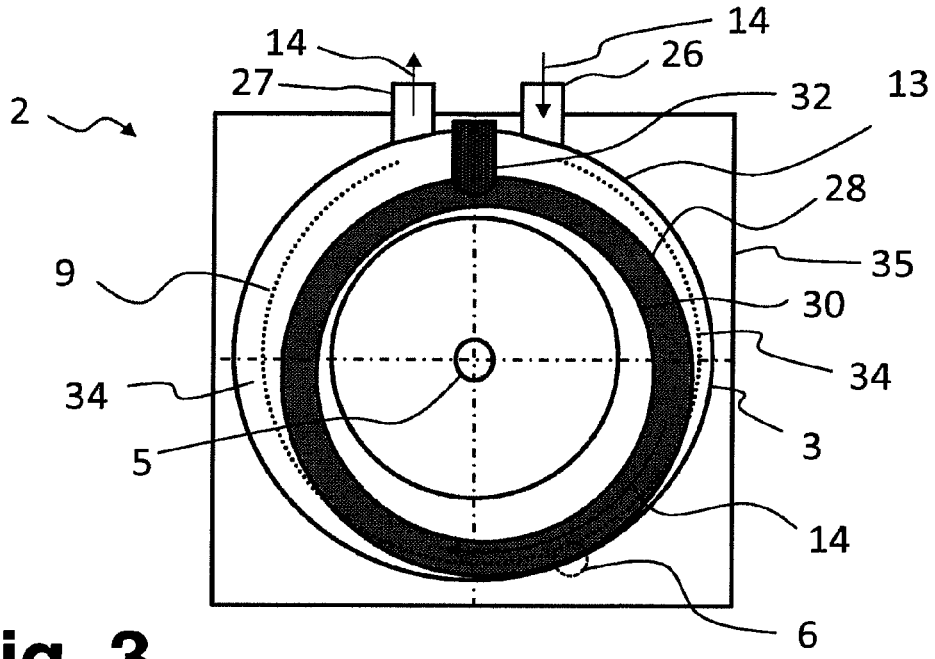
FIG. 3: is a sectional illustration, perpendicular to the drive shaft, through a second design variant of a pump for a described device.

In the second design variant of a pump 2 for a described device in FIG. 3, the pump chamber 3 or the delivery duct 13 is formed by a pump housing 35 and by a diaphragm 28 arranged within the pump housing 35. The diaphragm 28 is deformed by an eccentric drive 30 such that at least one seal 6 is formed between the pump housing 35 and the diaphragm 28. This seal 6 serves to form closed delivery volumes 34 within the pump chamber 3. The eccentric drive 30 is aligned with a drive shaft 5. Rotation of the eccentric drive 30 about the drive shaft 5 causes the diaphragm 28 to be deformed and the seal 6 to be moved, such that the closed delivery volumes 34 are displaced and liquid additive is delivered through the pump chamber 3 or along the delivery duct 13 in the delivery direction 14 from an inlet 26 to an outlet 27. Between the outlet 27 and the inlet 26 of the pump chamber 3 there is situated a seal in the form of a lug 32 which prevents the possibility of a return flow of liquid additive from the outlet 27 to the inlet 26 counter to the delivery direction 14. For this purpose, the lug 32 is in the form of an element that presses into the diaphragm 28 and produces a fluid-tight connection with the diaphragm 28 regardless of the angle of rotation of the eccentric drive 30.

Figure 4:
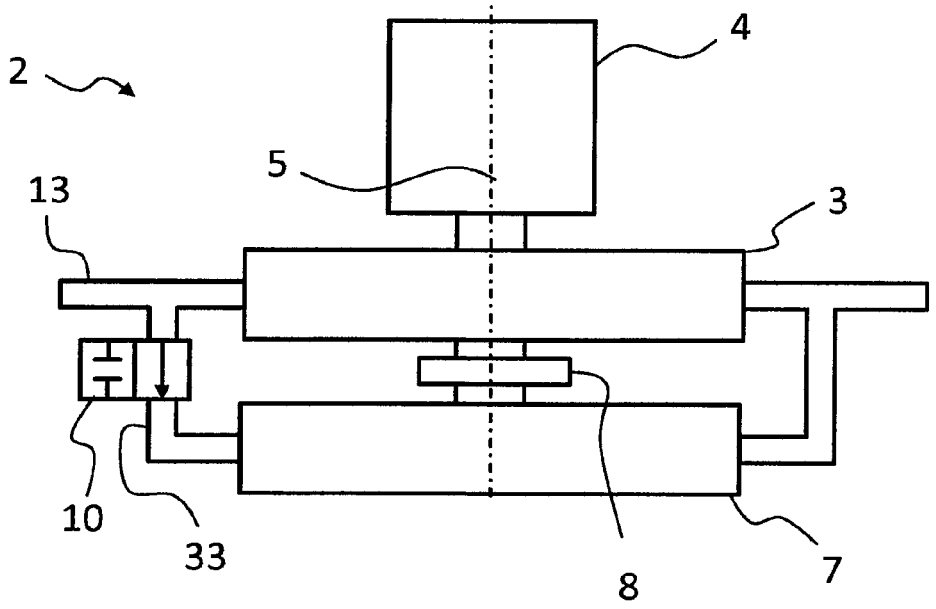
FIG. 4: is a schematic illustration of a first design variant of a pump for a described device.

In the design variant of a pump 2 for a described device as per FIG. 4, the rotary drive 4 is connected via the drive shaft 5 to a first pump chamber 3 and a second pump chamber 7. The second pump chamber 7 can be decoupled from the drive shaft 5 by a coupling 8. The first pump chamber 3 and the second pump chamber 7 are connected to a delivery duct 13 and can be connected in parallel with one another by a connecting line 33.

For this purpose, the connecting line 33 can be opened and closed by a valve 10.

Figure 5:
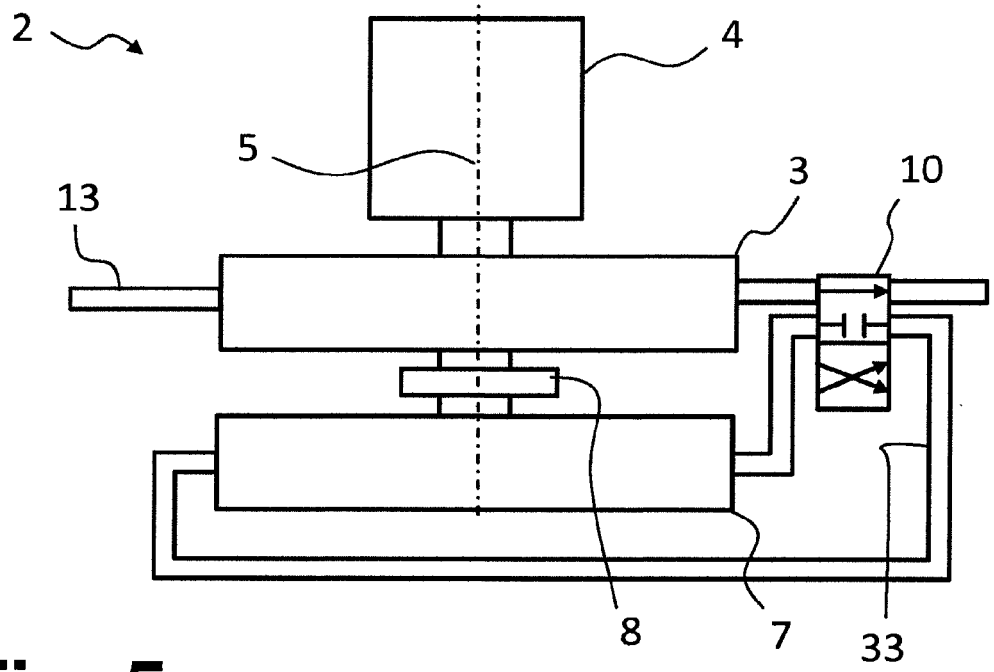
FIG. 5: is a schematic illustration of a second design variant of a pump for a described device.

In the design variant of a pump 2 as per FIG. 5, the first pump chamber 3 and the second pump chamber 7 are likewise connected by a drive shaft 5 to a rotary drive 4. In this case, too, the second pump chamber 7 can be decoupled from the drive shaft 5 by way of a coupling 8. The first pump chamber 3 and the second pump chamber 7 are connected to a delivery duct 13. The first pump chamber 3 and the second pump chamber 7 can be connected in series by a connecting line 33. For this purpose, a special valve 10 is provided by which the second pump chamber can be selectively integrated into or removed from the delivery duct 13.

Figure 6:
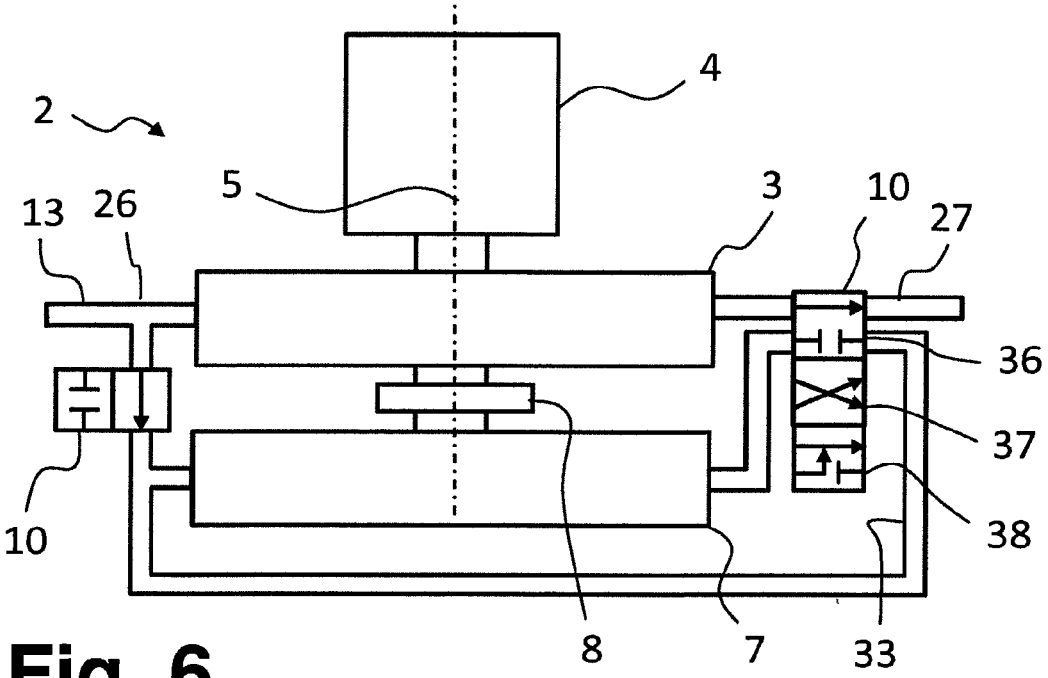
FIG. 6: is a schematic illustration of a third design variant of a pump for a described device.

In the design variant of a pump 2 as per FIG. 6, the rotary drive 4 is likewise connected via the drive shaft 5 to a first pump chamber 3 and a second pump chamber 7. In this case, too, the second pump chamber 7 can be decoupled from the drive shaft 5 by the coupling 8. A delivery duct 13 runs through the pump chamber 3. By the two valves 10, connecting lines 33 can be opened up so as to connect the second pump chamber 7 to the delivery duct 13. For this purpose, the valves have different valve positions which make it possible both for the first pump chamber 3 and the second pump chamber 7 to be connected in parallel and for the first pump chamber 3 and the second pump chamber 7 to be connected in series. For this purpose, at the inlet 26 into the first pump chamber 3, there is provided a valve 10 which makes it possible both for the second pump chamber 7 to be separated from the first pump chamber 3 and for the second pump chamber 7 to be connected to the first pump chamber 3. At the outlet 27 of the pump 2 there is arranged a valve 10 which has three different positions (a first valve position 36, a second valve position 37 and a third valve position 38), as has been discussed in more detail further above. The valve 10 may also be replaced by a combination of several conventional two-way valves and/or three-way valves.

Figure 7:
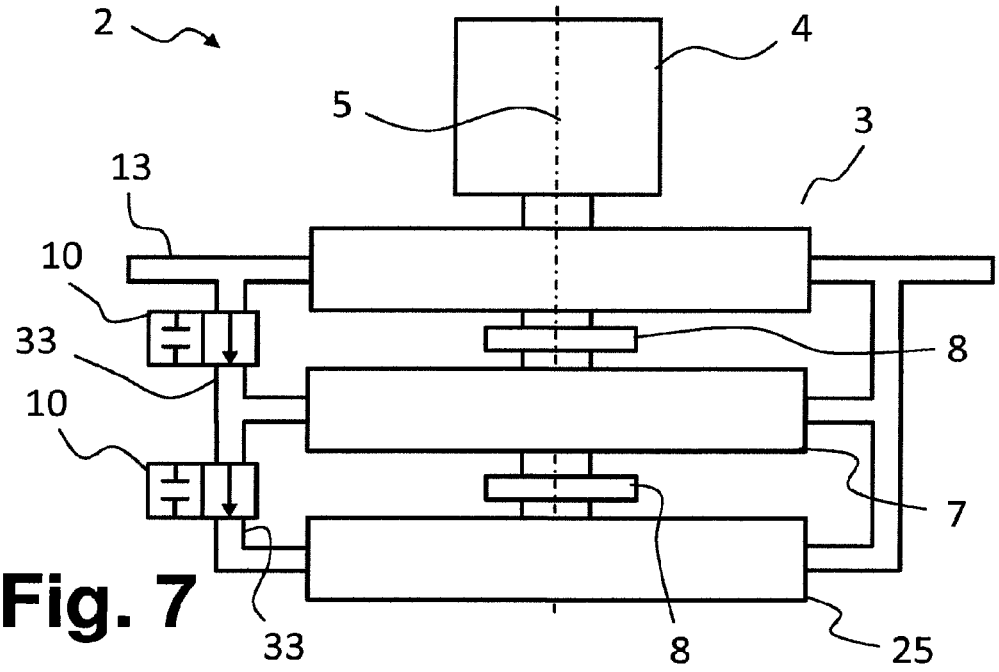
FIG. 7: is a schematic illustration of a fourth design variant of a pump for a described device.

In the design variant of a pump 2 as per FIG. 7, a third pump chamber 25 is also provided in addition to the first pump chamber 3 and the second pump chamber 7. It is optionally additionally possible for a fourth pump chamber (not illustrated here) to be provided. Altogether, with the arrangement illustrated in FIG. 7, it is possible for any desired number of pump chambers to be provided for connection in parallel. The first pump chamber 3, the second pump chamber 7 and the third pump chamber 25 are connected by a drive shaft 5 to a rotary drive 4. Couplings 8 are provided in each case between the individual pump chambers, by which couplings the second pump chamber 7 and the third pump chamber 25 can be decoupled from the drive shaft 5. The first pump chamber is connected to a delivery duct 13. By valves 10, it is possible for connecting lines 33 to the second pump chamber 7 and to the third pump chamber 25 to be opened up in order to selectively permit parallel operation of the first pump chamber 3, of the second pump chamber 7 and of the third pump chamber 25. Depending on the delivery demand on the pump 2, the pump can be operated selectively with one pump chamber, with two pump chambers or with three pump chambers.

Figure 8:
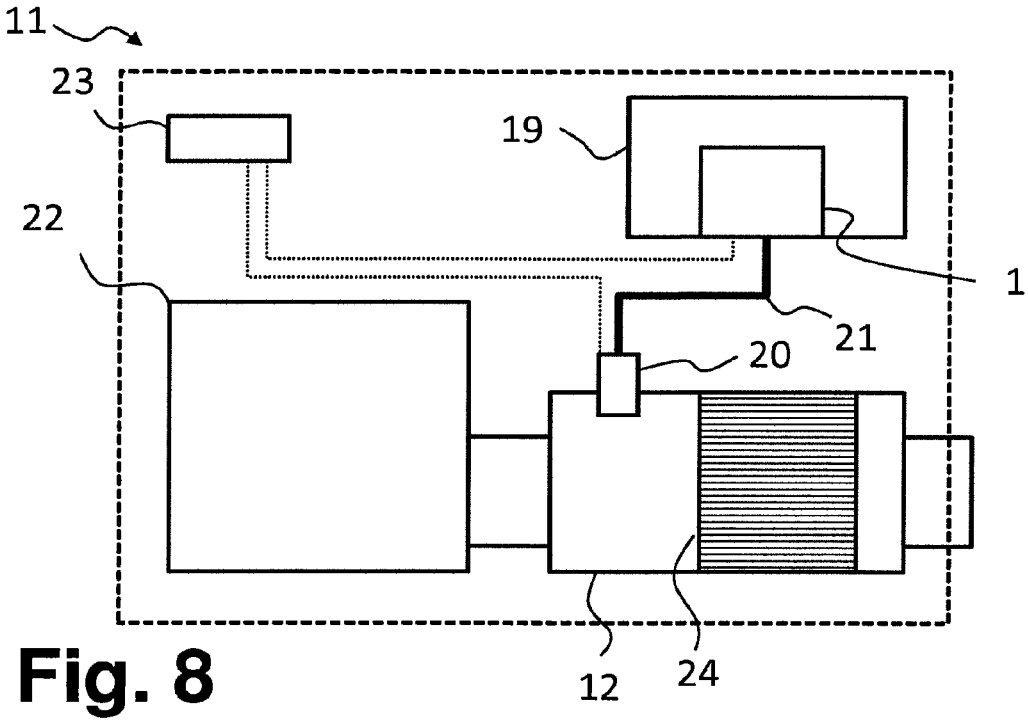
FIG. 8: shows a motor vehicle having a described device.

FIG. 8 shows a motor vehicle 11 having an internal combustion engine 22 and having an exhaust-gas treatment device 12 for the purification of the exhaust gases of the internal combustion engine 22. In the exhaust-gas treatment device there is provided an SCR catalytic converter 24 by which nitrogen oxide compounds in the exhaust gas of the internal combustion engine can be reduced. For this purpose, a liquid additive can be fed to the exhaust-gas treatment device 12 by a feed device 20. Liquid additive is supplied from a tank 19 to the feed device 20 via a line 21 by a device 1. The motor vehicle 11 also has a control unit 23 by which the device 1 and the feed device 20 can be controlled.

The invention described here makes it possible to realize a particularly advantageous device for supplying liquid additive, in which the delivery action of the device can be adapted in a particularly effective manner to the operating requirements of an exhaust-gas treatment device.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A device (1) for supplying a liquid additive, comprising:

a rotary drive (4) having a drive shaft (5);

at least one first pump chamber (3) configured to deliver the liquid additive, the first pump chamber (3) being arranged around the drive shaft (5) of the rotary drive (4);

at least one seal (6) arranged within the first pump chamber (3), the at least one seal being displaceable around the drive shaft (5) by the rotary drive (4);

at least one second pump chamber (7) arranged adjacent to the first pump chamber (3) along the drive shaft (5); and a deformable diaphragm (28) at least partially delimiting at least the at least one first pump chamber (3), the deformable diaphragm (28) forming the at least one seal (6), wherein the deformable diaphragm (28) is configured to be deformable by an eccentric drive (30) connected to the rotary drive (4) to effect displacement of the at least one seal (6), wherein the at least one first pump chamber (3) and the at least one second pump chamber (7) surround the drive shaft (5) in a circular arc segment (9) over at least 250 angular degrees.

2. The device (1) as claimed in claim 1, wherein the at least one second pump chamber (7) is structurally identical to the at least one first pump chamber (3).

3. The device (1) as claimed in claim 1, wherein the at least one second pump chamber (7) is connectable in parallel with the at least one first pump chamber (3) so as to increase the delivery rate of the device (1).

4. The device (1) as claimed in claim 1, further comprising a separable coupling (8) arranged between the at least one first pump chamber (3) and the at least one second pump chamber (7), said separable coupling (8) being configured so as to make the at least one second pump chamber (7) decoupleable from the drive shaft (5).

5. The device (1) as claimed in claim 1, wherein the at least one second pump chamber (7) is connectable in series with the at least one first pump chamber (3) so as to increase the delivery pressure of the device (1).

6. The device (1) as claimed in claim 1, further comprising at least one valve (10) by which at least one connecting line (33) between the at least one first pump chamber (3) and the at least one second pump chamber (7) is switchable.

7. A motor vehicle (11) comprising:

an internal combustion engine (22);

an exhaust-gas treatment device (12) for purification of exhaust gases of the internal combustion engine (22); and the device (1) as claimed in claim 1 for feeding a liquid additive to the exhaust-gas treatment device (12).

8. A device (1) for supplying a liquid additive, comprising:

a rotary drive (4) having a drive shaft (5);

at least one first pump chamber (3) configured to deliver the liquid additive, the first pump chamber (3) being arranged around the drive shaft (5) of the rotary drive (4);

at least one seal (6) arranged within the first pump chamber (3), the at least one seal being displaceable around the drive shaft (5) by the rotary drive (4);

at least one second pump chamber (7) arranged adjacent to the first pump chamber (3) along the drive shaft (5); and a pinch disk (31) connected to the rotary drive (4), and a hose (29) at least partially forming at least the at least one first pump chamber (3), wherein the at least one seal (6) is formed by the hose (29) being compressed in sections by the pinch disk (31), the hose (29) being configured to be deformable by the pinch disk (31) to effect displacement of the seal (6), wherein the at least one first pump chamber (3) and the at least one second pump chamber (7) surround the drive shaft (5) in a circular arc segment (9) over at least 250 angular degrees.

* * * * *